US010499463B2

(12) United States Patent
Viroli et al.

(10) Patent No.: US 10,499,463 B2
(45) Date of Patent: Dec. 3, 2019

(54) METHOD FOR CONTROLLING AN INDUCTION COOKING HOB WITH A POT DETECTION SYSTEM AND A CONTROL UNIT FOR CONTROLLING AN INDUCTION COOKING HOB WITH A POT DETECTION SYSTEM

(71) Applicant: Electrolux Home Products Corporation N. V., Brussels (BE)

(72) Inventors: Alex Viroli, Forli (IT); Massimo Nostro, Forli (IT); Laurent Jeanneteau, Forli (IT); Andrea Rossi, Forli (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 595 days.

(21) Appl. No.: 14/412,078

(22) PCT Filed: Apr. 23, 2013

(86) PCT No.: PCT/EP2013/058334

§ 371 (c)(1),
(2) Date: Dec. 30, 2014

(87) PCT Pub. No.: WO2014/005737

PCT Pub. Date: Jan. 9, 2014

(65) Prior Publication Data

US 2015/0156824 A1 Jun. 4, 2015

(30) Foreign Application Priority Data

Jul. 4, 2012 (EP) ..... 12174886

(51) Int. Cl.
*H05B 6/12* (2006.01)
*H05B 6/06* (2006.01)
*F24C 15/10* (2006.01)

(52) U.S. Cl.
CPC ..... *H05B 6/1209* (2013.01); *H05B 6/062* (2013.01); *H05B 2213/03* (2013.01); *H05B 2213/05* (2013.01)

(58) Field of Classification Search
CPC .. H05B 6/062; H05B 6/1209; H05B 2213/05; H05B 2213/03; H05B 6/1272; Y02B 40/126

(Continued)

(56) References Cited

U.S. PATENT DOCUMENTS 4,511,781 A * 4/1985 Tucker ..... H05B 6/062 219/506
5,243,172 A * 9/1993 Hazan ..... F24C 15/106 219/447.1

(Continued)

FOREIGN PATENT DOCUMENTS

DE 69118801 11/1996
DE 102010001002 A1 8/2010

(Continued)

OTHER PUBLICATIONS

International Search Report for PCT/EP2013/058334, dated Jun. 19, 2013, 2 pages.

(Continued)

*Primary Examiner* — Quang T Van
(74) *Attorney, Agent, or Firm* — Pearne & Gordon LLP

(57) ABSTRACT

A method for controlling an induction cooking hob with a pot detection system and a user interface. The method includes the steps of activating the induction cooking hob by touching a main switch by a user; starting automatically the pot detection system by a control unit of the induction cooking hob; and detecting at least one pot and/or pan on a cooking surface of the cooking hob or detecting if no pot or pan is placed on said cooking surface, by the pot detection system; deactivating the pot detection system after a predetermined time interval if no pot or pan or if no further pot or pan, respectively, has been detected on the cooking surface within the time interval; activating a deactivation indicator showing to the user that the pot detection system is deacti- (Continued)

vated, and providing an opportunity to reactivate the pot detection system by the user.

17 Claims, 1 Drawing Sheet

(58) Field of Classification Search
USPC ..... 219/620, 621, 622, 625, 626, 627, 506, 219/662, 665, 447.1; 99/330, 468, 476, 99/483, 516; 126/20, 369
See application file for complete search history.

(56) References Cited

U.S. PATENT DOCUMENTS

| | | | | |
|---|---|---|---|---|
| 5,680,810 | A * | 10/1997 | Sham | A47J 27/16 126/20 |
| 9,066,373 | B2 * | 6/2015 | Kulp, Jr. | H05B 6/062 |
| 2010/0243642 | A1 | 9/2010 | Gouardo et al. | |

FOREIGN PATENT DOCUMENTS

| | | |
|---|---|---|
| WO | 2011107325 | 9/2011 |
| WO | 2011107325 A1 | 9/2011 |

OTHER PUBLICATIONS

Office action issued in corresponding Australian Patent Application No. 2013286303 dated Sep. 20, 2016, 3 pages.
Extended European Search Report issued in corresponding European Patent Application No. 17192541.5 dated Feb. 9, 2018, 5 pages.

* cited by examiner

METHOD FOR CONTROLLING AN INDUCTION COOKING HOB WITH A POT DETECTION SYSTEM AND A CONTROL UNIT FOR CONTROLLING AN INDUCTION COOKING HOB WITH A POT DETECTION SYSTEM

BACKGROUND

The present invention relates to a method for controlling an induction cooking hob with a pot detection system according to the preamble of claim 1. Further, the present invention relates to to a control unit for controlling an induction cooking hob with a pot detection system according to the preamble of claim 5. Additionally, the present invention relates to a corresponding induction cooking hob.

There are types of induction cooking hobs comprising one cooking surface, on which the user may place pots or pans in an arbitrary position. Said cooking surface does not contain any drawings indicating cooking zones. The user is free to place the pots or pans. The position of the pots or pans does not depend on the cooking zones.

When the cooking hob is switched on, then a pot detection system is activated. Thus, the pot detection system of the cooking hob detects, if the user places the pots or pans on the cooking surface. For safety reasons the pot detection system must not remain activated forever, since the user could store a pot or pan on the cooking hob having forgotten that said cooking hob is activated.

DE 10 2005 028 095 A1 discloses a cooking hob with a security system. The security system comprises detection means for detecting movements in the kitchen. If no movements are detected, then the security system indicates an optical signal or sends an acoustic signal. After a predetermined time the cooking hob is deactivated. This is indicated by a further signal. The user may restart the cooking oven again.

DE 196 53 641 A1 discloses a cooking hob with infrared sensor for detecting the pot. If no pot is detected by said infrared sensor, then the cooking hob is deactivated. The user may restart the cooking hob by operating a switch.

EP 2 067 377 B1 discloses a cooking hob with a waiting mode, in which the cooking zone is deactivated. The waiting mode is activated, when a pot has been removed from the cooking zone.

DE 691 18 801 T2 discloses a heating plate with a pot detector. The heating power is deactivated or reduced, if the pot is removed from the heating plate. The user restarts the heating plate again after a hibernation mode.

WO 2001/107325 A1 discloses a method for controlling a cooking zone subdivided into at least two cooking sub-zones. Each cooking sub-zone is heated by at least one heating element. A pot detection system can be activated by the user or automatically, so that only the occupied cooking sub-zones are heated. At the end of a first pot detection phase, a subsequent further pot detection phase may be started only by the user.

US 2010/243642 A1 discloses a method for heating a container placed on a cooking hob by heating means associated to inductors. A heating area with a heating element arrangement is searched, which heating elements are at least partially covered by the container. A power supplied to each heating element is associated to the degree of coverage of said heating element by the container.

SUMMARY

It is an object of the present invention to provide a method and a control unit for controlling an induction cooking hob with a pot detection system, wherein the pot detection system provides an improved security system.

The object of the present invention is achieved by the methods described herein.

According to the present invention the method comprises the further steps of:

- activating a deactivation indicator showing to the user that the pot detection system is deactivated, and
- providing an opportunity to reactivate the pot detection system by the user.

The main idea of the present invention is the deactivation indicator showing that the pot detection system is deactivated on the one hand and the opportunity to reactivate the pot detection system by the user on the other hand. Thereby, only the pot detection system is deactivated, but not anything else. The indicator shows immediately to the user, if the pot detection system has been deactivated.

In particular, the method comprises the additional step of providing an opportunity to set the power for the at least one pot and/or pan by the user, after said at least one pot and/or pan have been detected by the pot detection system.

For example, the predetermined time interval for deactivating the pot detection system is between five minutes and twenty minutes. In particular, the predetermined time interval for deactivating the pot detection system is about ten minutes.

Preferably, the deactivation indicator provides an optical and/or acoustic signal to the user that the pot detection system is deactivated.

The object of the present invention is further achieved by the control unit as described herein.

According to the present invention

- the user interface includes a deactivation indicator showing to the user that the pot detection system is deactivated, and
- the user interface includes a reactivation element for reactivating the pot detection system by the user.

The control unit according to the present invention allows the indication showing that the pot detection system is deactivated on the one hand and the opportunity to reactivate the pot detection system by the user on the other hand, wherein only the pot detection system is deactivated, but not anything else. The indicator shows immediately to the user, if the pot detection system has been deactivated.

In particular, the user interface includes at least one power setting element providing an opportunity to set the power for the at least one pot and/or pan by the user, after said pot or pan has been detected by the pot detection system. The predetermined time interval for deactivating the pot detection system by the control unit may be between five minutes and twenty minutes. In particular, the predetermined time interval for deactivating the pot detection system by the control unit is about ten minutes.

Preferably, the deactivation indicator provides an optical and/or acoustic signal output device indicating that the pot detection system is deactivated.

According to one embodiment of the present invention, the user interface includes at least one touch-key panel arranged besides or inside the cooking surface.

In this case, the reactivation element is a reactivation key arranged on the touch-key panel, and/or the at least one power setting element is a power setting key arranged on the touch-key panel, wherein said reactivation key and/or at least one power setting key are formed as a touch-key in each case.

Further, the deactivation indicator may be a light emitting diode (LED) arranged on the touch-key panel.

According to another embodiment of the present invention, the user interface includes at least one touch screen arranged besides or inside the cooking surface.

In this case, the at least one power setting element may be a power setting icon arranged on the touch screen.

Moreover, the deactivation indicator and the reactivation element are formed as a common reactivation icon arranged on the touch screen.

At last, the present invention relates to a corresponding induction cooking hob. Said induction cooking hob may comprise the control unit according mentioned above. Further, the induction cooking hob may be provided for the method described above.

Novel and inventive features of the present invention are set forth in the appended claims.

BRIEF DESCRIPTION OF THE DRAWINGS

The present invention will be described in further detail with reference to the drawings, in which.

DETAILED DESCRIPTION

Figure 1:
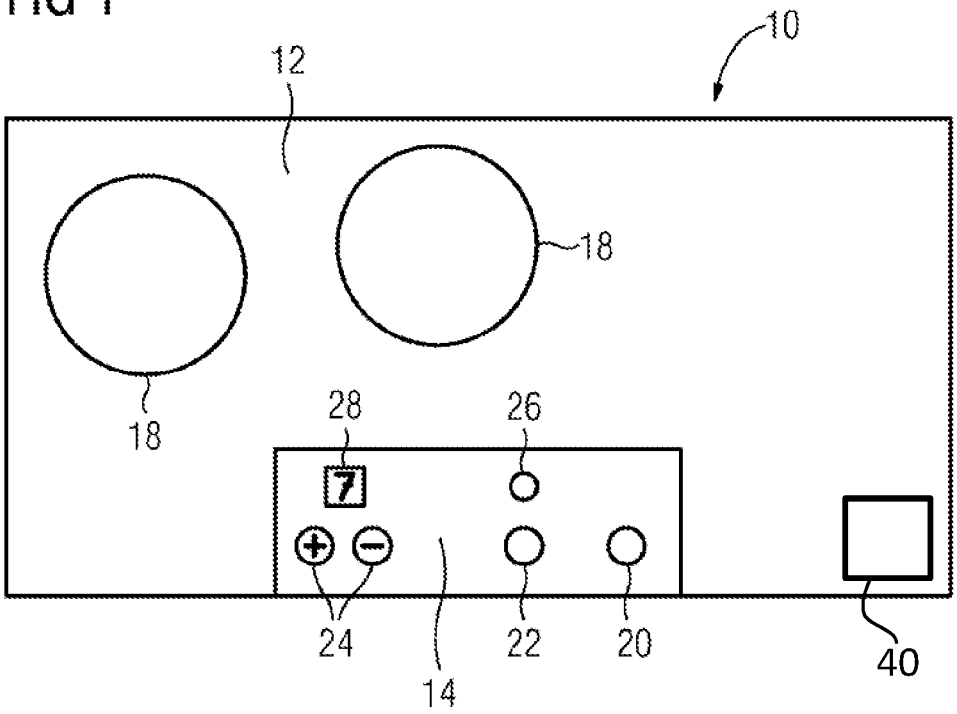
FIG. 1 illustrates a schematic top view of an induction cooking hob with a pot detection system and a user interface according to a first embodiment of the present invention.

FIG. 1 illustrates a schematic top view of an induction cooking hob 10 with a pot detection system 40 and a user interface 14 according to a first embodiment of the present invention. The induction cooking hob 10 comprises a cooking surface 12 and the user interface. In this embodiment, the user interface is a touch-key panel 14. In FIG. 1 two pots 18 and/or pans 18 are placed on the cooking surface 12.

The cooking surface 12 is not subdivided in predetermined cooking zones, but the pots 18 or pans 18 may be placed in arbitrary positions on the cooking surface 12. The pot detection system of the induction cooking hob 10 detects the position of the pots 18 and/or pans 18. Thus, only those induction coils arranged below the detected pots 18 and/or pans 18 are activated or can be activated.

The touch-key panel 14 includes a main switch 20, a reactivation key 22, two power setting keys 24, a deactivation indicator 26 and a power indicator 28. The one power setting key 24 is provided for increasing the power fed to the corresponding pot 18 or pan 18. In a similar way, the other power setting key 24 is provided for decreasing the power fed to the corresponding pot 18 or pan 18. In this example, the power setting keys 24 are marked by a plus sign and a minus sign, respectively. The deactivation indicator 26 is preferably a light emitting diode (LED). In this example, the power indicator 28 is a display showing a numerical value corresponding with the actual power.

The induction cooking hob 10 is activated, when the main switch 20 of the touch-key panel 14 is touched by the user. When the induction cooking hob 10 is activated, then also the pot detection system is started. Thus, the pots 18 or pans 18 arranged on the cooking surface 12 are detected by said pot detection system. In a similar way, the pot detection system may detect, if no pot 18 or pan 18 is placed on the cooking surface 12. Next, the user may decide, if he wants to set the power fed to the pots 18 and/or pans 18. The power is set by touching the power setting keys 24 on the touch-key panel 14. After a predetermined time, the detection system is deactivated, if no further pot 18 or pan 18 is detected on the cooking surface 12. The detection system is also deactivated after the predetermined time, if no pot 18 or pan 18 has been detected on the cooking surface 12 at the point in time of activating the induction cooking hob 10 and during said predetermined time. Preferably, said predetermined time is about ten minutes. Additionally, the deactivation indicator 26 on the touch-key panel 14 is activated. The deactivation indicator 26 including the light emitting diode shows to the user, that the detection system has been deactivated. Now, the user may reactivate the detection system by touching the reactivation key 22 on the touch-key panel 14.

Alternatively or additionally to the optical signal from the light emitting diode, the deactivation indicator 26 may output an acoustic signal.

Figure 2:
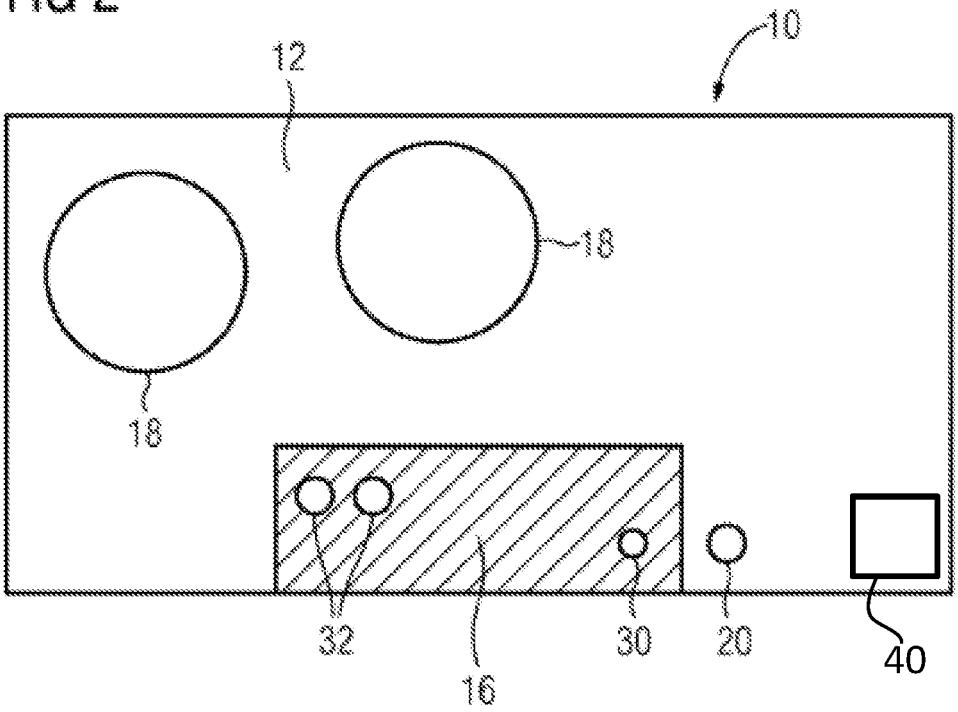
FIG. 2 illustrates a schematic top view of an induction cooking hob with a pot detection system and a user interface according to a second embodiment of the present invention.

FIG. 2 illustrates a schematic top view of the induction cooking hob 10 with the pot detection system 40 and the user interface 16 according to a second embodiment of the present invention. The induction cooking hob 10 comprises the cooking surface 12 and the user interface 16. In this embodiment, the user interface is a touch screen 16.

The pots 18 and/or pans 18 may be also placed in arbitrary positions on the cooking surface 12. The induction cooking hob 10 includes the detection system for detecting the position of the pots 18 and/or pans 18, so that only those induction coils arranged below the detected pots 18 and/or pans 18 are activated or can be activated.

The touch screen 16 includes a reactivation icon 30 and two power setting icons 32. In this example, the main switch 20 is separate and arranged besides the touch screen 16 on the cooking surface 12. The one of the two power setting icons 32 is provided for increasing the power fed to the corresponding pot 18 or pan 18. In a similar way, the other of the two power setting icons 32 is provided for decreasing the power fed to the corresponding pot 18 or pan 18. Thus, the power setting icons 32 have the same functions as the power setting key 24 of the first embodiment. The reactivation icon 30 of the touch screen 16 combines the functions of the deactivation indicator 26 and the reactivation key 22 of the first embodiment. Further, the touch screen 16 may include an icon showing the value of the actual power as the power indicator 28 of the first embodiment.

The induction cooking hob 10 is activated, when the main switch 20 on the cooking surface 12 is touched by the user. When the induction cooking hob 10 has been activated, the pot detection system is also started. Thus, the pots 18 or pans 18 arranged on the cooking surface 12 are detected by said pot detection system. Further, the pot detection system also detects, if no pot 18 or pan 18 is placed on the cooking surface 12. In this situation, the user may decide, if he wants to set the power fed to the pots 18 and/or pans 18. The power is set by touching the power setting icons 32 on the touch screen 16. After the predetermined time, the detection system is deactivated, if a further pot 18 or pan 18 has not been detected on the cooking surface 12 in the meantime. The detection system is also deactivated after the predetermined time, if no pot 18 or pan 18 has been detected on the cooking surface 12 at the point in time of activating the induction cooking hob 10 and during said predetermined time. Preferably, the predetermined time is about ten minutes. Moreover, the reactivation icon 30 on the touch screen 16 is activated. The reactivation icon 30 shows to the user, that the detection system has been deactivated, on the one hand, and the user may reactivate the detection system by touching said reactivation icon 30 on the other hand.

Alternatively or additionally to the optical signal from the reactivation icon 30, the pot detection system may output an acoustic signal.

The method for controlling the induction cooking hob 10 and the corresponding control unit according to the present invention allow that the induction cooking hob 10 works in a safe way. The control unit indicates to the user, if the pot detection system is disabled, and provides simple reactivation means for restarting the pot detection system.

The deactivation of the pot detection system reduces the power fed to the induction cooking hob 10, in particular, if there are no active pots or pans on the cooking surface 12.

The present invention has been described by example of the induction cooking hob 10. However, the present invention may be also applied to other kinds of cooking hobs. In particular, the present invention is suitable for cooking hobs, wherein the cooking surface 12 has no defined cooking zones, so that the user may place the pot or pan in an arbitrary position.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 cooking surface
14 touch-key panel
16 touch screen
18 pot, pan
20 main switch
22 reactivation key
24 power setting key
26 deactivation indicator
28 power indicator
30 reactivation icon
32 power setting icon

The invention claimed is:

1. A method for controlling an induction cooking hob with a pot detection system and a user interface, wherein said method comprises the following steps:

activating the induction cooking hob by touching a main switch by a user, starting automatically the pot detection system by a control unit of the induction cooking hob, detecting at least one pot and/or pan on a cooking surface of the cooking hob, or detecting if no pot or pan is placed on said cooking surface, by the pot detection system, deactivating the pot detection system after a predetermined time interval if no pot or pan or if no further pot or pan, respectively, has been detected on the cooking surface within said time interval, activating a deactivation indicator showing to the user that the pot detection system is deactivated, and providing an opportunity to reactivate the pot detection system by the user.

2. The method according to claim 1, further comprising providing an opportunity to set the power for the at least one pot and/or pan by the user, after said at least one pot and/or pan have been detected by the pot detection system.

3. The method according to claim 1, wherein the predetermined time interval for deactivating the pot detection system is between five minutes and twenty minutes.

4. The method according to claim 1, wherein the deactivation indicator provides an optical and/or acoustic signal to the user that the pot detection system is deactivated.

5. A control unit for controlling an induction cooking hob with a pot detection system, wherein:

the control unit comprises a user interface, the user interface includes a main switch for activating the induction cooking hob, the control unit is provided to start automatically the pot detection system, the pot detection system is provided for detecting at least one pot and/or pan on a cooking surface of the cooking hob, or for detecting if no pot or pan is placed on said cooking surface, and the control unit is provided for deactivating the pot detection system after a predetermined time interval, if no pot or pan or no further pot or pan, respectively, has been detected on the cooking surface within said time interval, the user interface comprising a deactivation indicator showing to the user that the pot detection system is deactivated, and the user interface further comprising a reactivation element for reactivating the pot detection system by the user.

6. The control unit according to claim 5, wherein the user interface includes at least one power setting element providing an opportunity to set the power for the at least one pot and/or pan by the user, after said pot and/or pan have been detected by the pot detection system.

7. The control unit according to claim 5, wherein the predetermined time interval for deactivating the pot detection system by the control unit is between five minutes and twenty minutes.

8. The control unit according to claim 5, wherein the deactivation indicator provides an optical and/or acoustic signal output device indicating that the pot detection system is deactivated.

9. The control unit according to claim 5, wherein the user interface includes at least one touch-key panel arranged beside or inside the cooking surface.

10. The control unit according to claim 9, wherein the reactivation element is a reactivation key arranged on the touch-key panel, and/or the at least one power setting element is a power setting key arranged on the touch-key panel, wherein said reactivation key and/or at least one power setting key are formed as a touch-key in each case.

11. The control unit according to claim 9, wherein the deactivation indicator is a light emitting diode (LED) arranged on the touch-key panel.

12. The control unit according to claim 5, wherein the user interface includes at least one touch screen arranged beside or inside the cooking surface.

13. The control unit according to claim 12, wherein the at least one power setting element is a power setting icon arranged on the touch screen.

14. The control unit according to claim 12, wherein the deactivation indicator and the reactivation element are formed as a common reactivation icon arranged on the touch screen.

15. An induction cooking hob with a pot detection system and a user interface, said induction cooking hob comprising the control unit according to claim 5.

16. The method according to claim 3, said predetermined time interval being ten minutes.

17. The control unit according to claim 7, said predetermined time interval being ten minutes.

* * * * *